United States Patent [19]

Yoshizuka

[11] Patent Number: 5,066,977

[45] Date of Patent: Nov. 19, 1991

[54] SYSTEM FOR MANAGING THE NUMBER OF IMAGE FORMING OPERATIONS IN AN IMAGE FORMING APPARATUS

[75] Inventor: Ken Yoshizuka, Nagaokakyo, Japan

[73] Assignee: Mita Industrial Co., Ltd., Osaka, Japan

[21] Appl. No.: 567,078

[22] Filed: Aug. 14, 1990

[30] Foreign Application Priority Data

Aug. 31, 1989 [JP] Japan ..... 1-226758

[51] Int. Cl.[5] ..... G03G 21/00

[52] U.S. Cl. ..... 355/201; 364/406; 377/16

[58] Field of Search ..... 355/201, 206, 308, 316, 355/204, 133, 200, 202, 309; 377/8, 15, 16; 364/406

[56] References Cited

U.S. PATENT DOCUMENTS

| | | | |
|---|---|---|---|
| 3,813,157 | 5/1974 | Fantozzi | 355/308 |
| 3,872,282 | 3/1975 | Long | 355/308 X |
| 4,501,485 | 2/1985 | Tsudaka | 355/201 |
| 4,531,826 | 7/1985 | Stoughton et al. | 355/201 |

FOREIGN PATENT DOCUMENTS

| | | | |
|---|---|---|---|
| 0070554 | 5/1982 | Japan | 355/201 |
| 0024858 | 2/1984 | Japan | 355/201 |
| 0005261 | 1/1987 | Japan | 355/201 |

*Primary Examiner*—R. L. Moses
*Assistant Examiner*—William J. Royer
*Attorney, Agent, or Firm*—Beveridge, DeGrandi & Weilacher

[57] ABSTRACT

A system for managing the number of image forming operations of an image forming apparatus is provided, wherein when the accumulated number of copies for a user exceeds a predetermined copying number to be allowed for the user, the copying operation is forced to continue up to the number of copies specified by the user at that time. However, when this condition is detected, an instruction for inhibiting the next copying operation by that user is delivered to a main unit of the image forming apparatus. The excess number of copies over the predetermined number is designated as the initial setting number in an accumulator for calculating an accumulated number of copies after resetting by a renewal arrangement.

4 Claims, 2 Drawing Sheets

SYSTEM FOR MANAGING THE NUMBER OF IMAGE FORMING OPERATIONS IN AN IMAGE FORMING APPARATUS

BACKGROUND OF THE INVENTION

1. Field of the Invention

The present invention relates to a management system of an image forming apparatus, such as a copy machine, for controlling the number of image formed pieces per user thereof.

2. Description of the Related Art

There has been known such a prior art management system in a copy machine as disclosed in Japanese Utility-model Unexamined Publication 62-51351 (1987).

That copy machine is commonly used by a plurality of users for copying operation. Each user is allowed to have a predetermined number of copies at maximum and an excess of copies over the predetermined number cannot be accepted. If the number of copies desired exceeds the predetermined number, an arrangement of renewal, e.g. by paying a fee of copying, is required for further copying.

In operation, the user enters his identification code through a console of the copy machine and then, types ten keys to have a desired number of copies, as followed by the operation of copying an original document.

The management system in the copy machine is actuated to record the accumulated number of copies of each user and compare it with the predetermined number which has been preset individually.

As the result of comparison, when the accumulated number exceeds the predetermined number, the action of copying is immediately stopped. For example, even if the user wants 20 copies, 5 copies only happen to be permitted. It is however difficult for the user to judge whether a desired number of copies to be reproduced at present exceeds the predetermined number, prior to the actual copying operation.

SUMMARY OF THE INVENTION

It is an object of the present invention to overcome the above problem associated with the prior art.

A management system of an image forming apparatus according to the present invention is provided comprising: a code input means for input of a user code; a sheet counter for counting the number of copies in a main unit of the image forming apparatus; an accumulating means for calculating an accumulated number of copies for each user from the date in the user code supplied from the code input means and the count number counted by the sheet counter; a limit setting means for setting a predetermined number of copies assigned to the user; a limit memory means for recording the predetermined number of the user present by the limit setting means; a comparing means for comparing between the predetermined number recorded in the limit memory means and the accumulated number calculated by the accumulating means; and a controlling means for upon judging from the comparison at the comparing means that the accumulated number of the user exceeds the predetermined number, forcing the copying operation to continue up to a specified number of copies desired at the time by the user and simultaneously, delivering an instruction of the main unit of the copy machine for inhibiting the copying operation by the user from the next time and designating an excess of copies over the predetermined number as the initial setting number of the accumulating means for calculation an accumulated number after resetting by renewal arrangement.

DESCRIPTION OF THE PREFERRED EMBODIMENT

Figure 1:
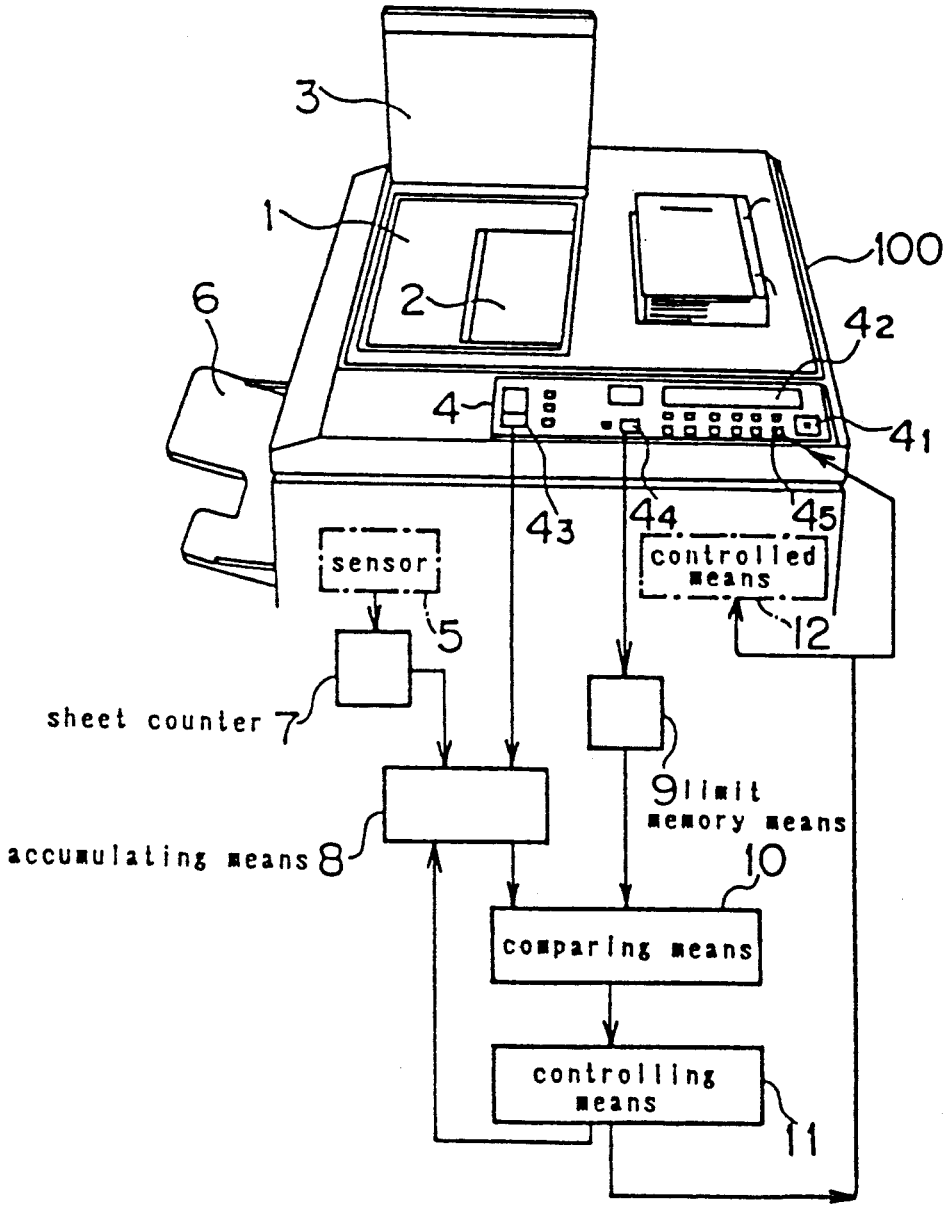
FIG. 1 is a block diagram of a management system of an image forming apparatus showing one embodiment of the present invention.

FIG. 1 is a block diagram of a management system of an image forming apparatus showing one embodiment of the present invention, in which an original document 2 is placed on an original carrier platen 1. Also, an original holder cover 3 is provided for holding the original 2 over the original carrier platen 1. An operation panel 4 is mounted in the upper front of a main body 100 of a copy machine, containing a copy start key $4_1$, a liquid crystal display $4_2$ for displaying various kinds of numerals, characters, alarms and ten-key pads, and other means for instruction entry and display during the operation of the copy machine by users. FIG. 1 illustrates a receiving tray 6 for receiving copied document sheets transferred.

The operation panel 4 also includes a code input means $4_3$ for entry of a personal code of the user. For example, the entry of the personal code can be made by using code and numeral keys on the panel or inserting an IC card (not shown).

There is provided a sensor 5 which is a limit switch or a photo-sensor for detection of transferring copied sheets by the main body 100 of the copy machine.

The copied sheets which are detected by the sensor 5 are then counted by a sheet counter 7 consecutively.

Also, an accumulating means 8 is provided for calculating the accumulated number of copies associated with the user by summing the data number in the user code input by the code input means $4_3$ and the number counted by the sheet counter 7.

A limit setting means $4_4$ is provided for setting the limit or maximum number of copies to be allowed for each user. For example, the setting of the limit number can be made using limit setting keys and numeral keys. Because of being defined by the limit number, the user is not usually allowed to copy more than the limit number. Hence, when desired, a renewal arrangement, e.g. payment of a new copying fee, is needed for resetting the limit number for further copying.

A limit memory means 9 is provided for memory of the limit number of copies of each user determined by the limit setting means $4_4$ and may be composed of a RAM.

A comparing means 10 is provided for comparing between the accumulated number of copies of a user calculated by the accumulating means 8 and the limit number of the user recorded in the limit memory means 9.

A controlling means 11 is provided which upon judging from the comparison at the comparing means 10 that the accumulated number of a user exceeds his limit number, can force the copying operation to continue up to a specified number of copies desired at the time by the user and simultaneously, deliver an instruction to the copy machine main body 100 for inhibiting the copying operation by the user from the next time, and will also instruct the accumulating means 8 to designate an excess of copies over the limit number as the initial setting number for calculation of an accumulated number at the first time after resetting by renewal arrangement. The controlling means 11 may preferably be a microcomputer.

A controlled means 12 is also provided for inhibiting the copying operation by the user at the next time in response to the instruction from the controlling means 11.

The accumulating means 8 is adapted for determining an excess of copies over the limit number as the initial setting number assigned to the user for renewal operation of copying with permission.

The controlling means 11 may give a notice to the user when the number of his copies exceeds the limit number by means of a buzzer, an LED $4_5$, or the like.

The managing on copying may be carried out in a given mode which is arbitrarily selectable with a managing mode selector key mounted on the operation panel 4.

Figure 2:
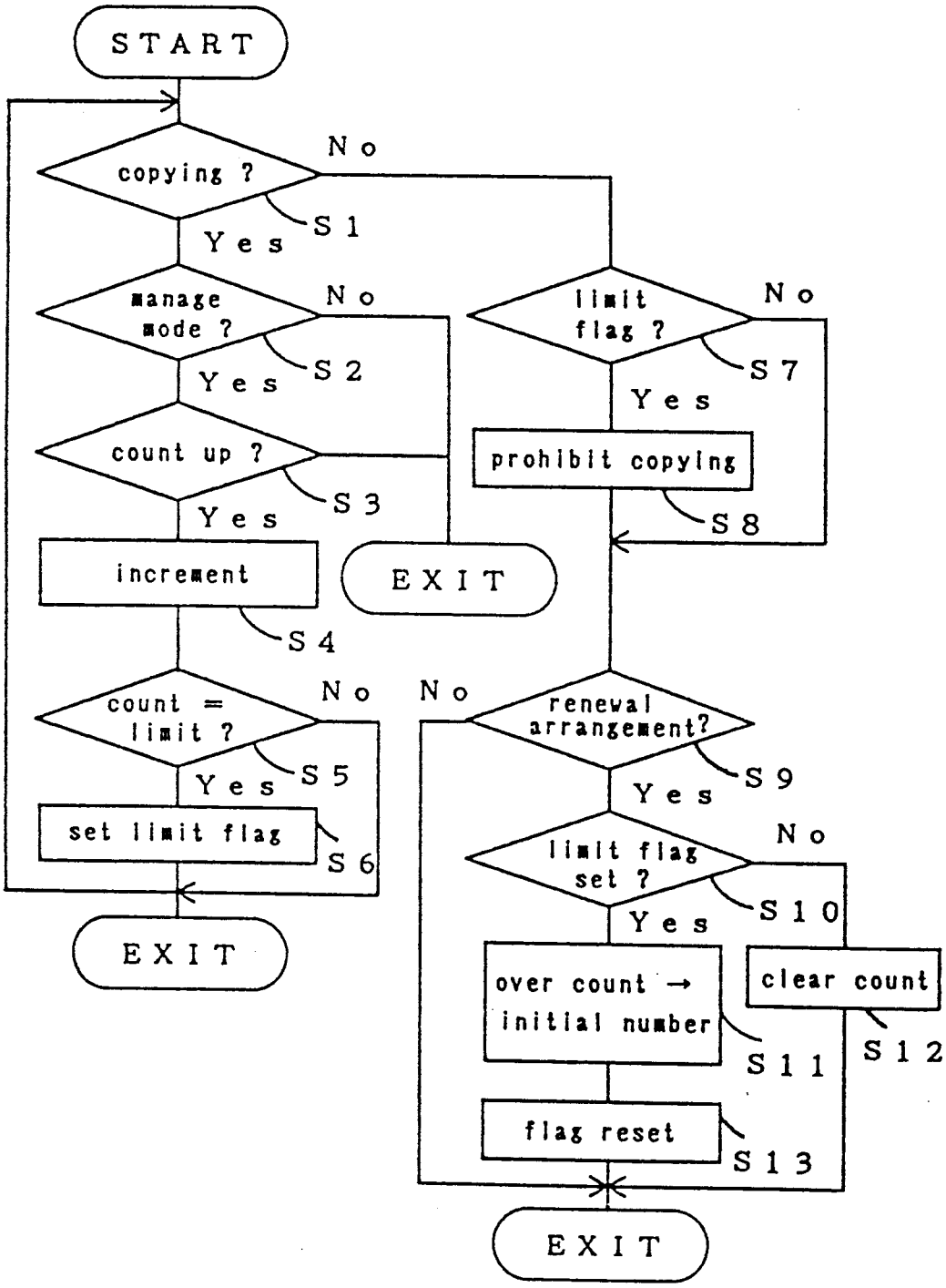
FIG. 2 is a flow chart showing the procedure of the embodiment.

The operation according to the present invention is described referring to a flow chart shown in FIG. 2.

The limit number of copies for each user is preliminarily determined by the limit setting means $4_4$. The limit number predetermined by the limit setting means $4_4$ is then fed to the limit memory means 9 for memory.

When copying is needed, a user inputs his code using the code input means $4_3$ and then, presses the start key $4_1$ for starting the copying (Step S1).

It is determined whether the apparatus is in the managing mode or not (Step S2). When in the managing mode, the sensor 5 detects the presence of copied sheets while the sheet counter 7 counts up the number of the copied sheets. The accumulating means 8 calculates by adding the recorded number corresponding to the user code, to the counted number (Steps S3 and S4).

The accumulated number at the accumulating means 9 is compared with the limit number of the user recorded in the memory means 9 by comparing means 10 (Steps S5).

When the accumulated number exceeds the limit number (Step S5), a limit flag is set by the controlling means 11 (Step S6). When less than the limit number, no limit flag is applied. Also, when exceeding, a warning is provided.

The copying operation is carried out throughout the procedure (from S1 to S6) and will not be interrupted prior to the end of the operation even if the limit flag is introduced.

When the copying operation is completed (Step S1), the controlling means 11 examines the limit flag (Step S7). When the limit flag is present, any further copying by the user is prohibited (Step S8). When the limit flag is not set (Step S7), no prohibition is given.

When renewal arrangement is made for resetting of the managing e.g. as a fee of copying has been paid by the user (Step S9), the presence of the limit flag is examined (Step S10). When the limit flag is present (Step S10), an excess of copies over the previous limit number is designated as the initial setting of an accumulated number by the accumulating means 8 (Step S11) and the flag will thus be removed (Step S13). When the limit flag is not present (Step S10) initial setting of an accumulated number is designated as 0 (Step S12).

Also, instead of having the initial setting of an accumulated number increased by an excess of copies over the limit number, the limit number to be allowed for the user may be reduced by the same when a renewal arrangement for copying is engaged.

The present invention is applicable to the management system in an image forming apparatus other than a copying machine, such as a printer, a facsimile machine, or the like.

As described previously, the management system of an image forming apparatus according to the present invention allows the current operation of copying to be completed even if the number of existing copies exceeds the limit number during the operation, while controlling the limit number to be reduced by a number of copies surplus to the limit number at the next operation, so that image forming cannot be interrupted during the copying operation.

It is further understood by those skilled in the art that the foregoing description is a preferred embodiment and that various changes and modifications may be made in the invention without departing from the spirit and scope thereof.

I claim:

1. A system for managing the number of image forming operations of an image forming apparatus comprising:

a code input means for inputting a user code;

a sheet counter for counting a number of sheets processed by a main unit of said image forming apparatus;

an accumulating means for calculating an accumulated number of sheets for each user from data in said user code supplied from said code input means and a count number counted by said sheet counter;

a limit setting means for setting a predetermined number of sheets assigned to said user;

a limit memory means for recording said predetermined number of sheets said user set by said limit setting means;

a comparing means for comparing between said predetermined number of sheets recorded in said limit memory means and said accumulated number of sheets calculated by said accumulating means; and a controlling means for, upon judging from said comparing at said comparing means that said accumulated number of sheets of said user exceeds said predetermined number of sheets, forcing image forming operation of said apparatus to continue up to a specified number of sheets desired at the time by said user and means for delivering an instruction to said main unit of said apparatus for inhibiting image forming operation of said apparatus by said user from the next time and designating an excess number of sheets over said predetermined number of sheets as an initial setting number of said accumulating means for calculation of an accumulated number of sheets after resetting by a renewal arrangement.

2. A system for managing the number of image forming operations of an image forming apparatus comprising:

a code input means for inputting a user code;

a sheet counter for counting a number of sheets processed by a main unit of said image forming apparatus;

an accumulating means for calculating an accumulated number of sheets for each user from data in said user code supplied from said code input means and a count number counted by said sheet counter;

a limit setting means for setting a predetermined number of sheets assigned to said user;

a limit memory means for recording said predetermined number of sheets said user set by said limit setting means;

a comparing means for comparing between said predetermined number of sheets recorded in said limit memory means and said accumulated number of sheets calculated by said accumulating means; and a controlling means for, upon judging from said comparing at said comparing means that said accumulated number of sheets of said user exceeds said predetermined number of sheets, forcing said image forming operation of said apparatus to continue up to a specified number of sheets desired at the time by said user and means for delivering an instruction to said main unit of said apparatus for inhibiting image forming operation of said apparatus by said user from the next time and making said number of sheets assigned to said user to be reduced by the number of excess of sheets over said predetermined number of sheets when a renewal arrangement for the image forming of said apparatus is engaged.

3. A system for managing the number of image forming operations of an image forming apparatus according to claim 1, wherein:

said controlling means is adapted for giving a warning sign when said accumulated number of sheets exceeds said predetermined number of sheets assigned to said user.

4. A system for managing the number of image forming operations of an image forming apparatus according to claim 2, wherein:

said controlling means is adapted for giving a warning sign when said accumulated number of sheets exceeds said predetermined number of sheets assigned to said user.

* * * * *